US005307658A

United States Patent [19]

Kokubu et al.

[11] Patent Number: 5,307,658

[45] Date of Patent: May 3, 1994

[54] KEY CYLINDER DEVICE

[75] Inventors: Sadao Kokubu; Hisashi Aoki; Yoshiyuki Mizuno, all of Aichi, Japan

[73] Assignee: Kabushiki Kaisha Tokai Rika Denki Seisakusho, Aichi, Japan

[21] Appl. No.: 922,381

[22] Filed: Jul. 31, 1992

[30] Foreign Application Priority Data

Aug. 2, 1991 [JP] Japan ..... 3-217951
Dec. 17, 1991 [JP] Japan ..... 3-353593

[51] Int. Cl.[5] ..... E05B 17/22

[52] U.S. Cl. ..... 70/427; 70/276; 70/408

[58] Field of Search ..... 70/455, 423, 427, 277, 70/276, 278, 408

[56] References Cited

U.S. PATENT DOCUMENTS

| | | | |
|---|---|---|---|
| 3,660,624 | 5/1972 | Bell | 70/388 |
| 4,594,866 | 6/1986 | Neyret | 70/423 |
| 4,868,409 | 9/1989 | Tanaka et al. | 70/278 |
| 4,916,927 | 4/1990 | O'Connell et al. | 70/277 |
| 4,918,955 | 4/1990 | Kimura et al. | 70/277 |
| 5,003,801 | 4/1991 | Stinar et al. | 70/278 |
| 5,117,097 | 5/1992 | Kimura et al. | 70/278 |

FOREIGN PATENT DOCUMENTS

| | | | |
|---|---|---|---|
| 8301808 | 5/1983 | European Pat. Off. . | |
| 2204353 | 11/1988 | European Pat. Off. . | |
| 0324096 | 7/1989 | European Pat. Off. . | |
| 0430732 | 6/1991 | European Pat. Off. | 70/256 |
| 2187227 | 9/1987 | United Kingdom | 70/277 |

*Primary Examiner*—Peter M. Cuomo
*Assistant Examiner*—Darnell M. Boucher
*Attorney, Agent, or Firm*—Finnegan, Henderson, Farabow, Garrett & Dunner

[57] ABSTRACT

An object of this invention is to provide a key cylinder device which is simple in structure and is able to positively detect the presence or absence of the key. In a key cylinder device, a key cylinder body incorporates a rotor having a key inserting inlet, and a shutter made of a magnetic material is swingably mounted in the rotor to open and close the key inserting inlet, the shutter being urged by a spring to close the key inserting inlet. When the shutter is held closed, the magnetic force of a permanent magnet acts on a normally closed lead switch to hold the switch open. When the shutter is swung open by the key being inserted into the key inserting inlet, it covers the permanent magnet, thus interrupting the action of the magnetic force of the permanent magnet on the lead switch. As a result, the reed switch closes.

5 Claims, 5 Drawing Sheets

KEY CYLINDER DEVICE

BACKGROUND OF THE INVENTION

This invention relates to a signal transmitter comprising a signal transmitting circuit for transmitting a signal propagating in the air (hereinafter referred to as "an air propagation signal", when applicable) and its power source which are mounted on a key which is to be inserted into the key cylinder. Moreover, this invention relates to a key cylinder device which is capable of detecting the presence or absence of the key.

Recently, some motor vehicles have been equipped with a so-called "wireless door locking device". The wireless door locking device is designed as follows: A signal transmitting circuit and its power source, namely, a battery are mounted on an ignition key, which can be inserted into the ignition key cylinder and the door key cylinder. The signal transmitting circuit is activated by the driver to transmit a radio wave signal. The radio wave signal thus transmitted is detected by received-signal discriminating means. When it is determined that the radio wave signal is the one predetermined for the door of the motor vehicle, an electric actuator is operated to automatically lock or unlock the door.

The wireless door locking device is convenient in practical use, because the door is locked or unlocked merely by operating an operating button to transmit the radio wave signal.

However, the wireless door locking device suffers from the following difficulty: When the power source, namely, the power of the battery is consumed up, it is no longer possible for the signal transmitting circuit to transmit the radio wave signal; that is, it is impossible to lock or unlock the door with the radio wave signal.

On the other hand, a key cylinder device, for instance, for the door of a motor vehicle which has means for electrically detecting the insertion of the key into the key cylinder or the removal of it therefrom; i.e., the presence or absence of the key, has not been put in practical use yet.

A key cylinder device of this type, being exposed outside the vehicle body, is liable to be adversely affected by external environmental conditions. Hence, it is rather difficult for the key cylinder device to include the aforementioned detecting means for electrically detecting the presence or absence of the key. It is not impossible for the key cylinder device to include the detecting means; however, the resultant key cylinder device including the detecting means is intricate in structure and accordingly bulky as well.

SUMMARY OF THE INVENTION

In view of the foregoing, an object of this invention is to provide a signal transmitter in which its signal transmitting circuit can be activated even when its power source has become inactive and is consumed up; that is, no electric power is provided for the signal transmitting circuit.

Another object of this invention is to provide a key cylinder device which is simple in construction and is positively able to electrically detect the presence or absence of the key.

According to an aspect of the present invention, there is provided a signal transmitter comprising: a key which is to be inserted into a key cylinder; a signal transmitting circuit for transmitting an air propagation signal; and a power source for the signal transmitting circuit, the signal transmitting circuit and the power source being provided on the key, in which, according to the invention, the key cylinder has detecting means for detecting the insertion of the key into the key cylinder, and a primary coil which is energized when the detecting means detects the insertion of the key into the key cylinder, and the key has a secondary coil in which an electromotive force is induced as current flowing in the primary coil varies with the key inserted into the key cylinder, the electromotive force thus induced in the secondary coil being utilized to activate the signal transmitting circuit.

In the ordinary case where the power source is active, the signal transmitting circuit is operated to transmit the air propagation signal. However, if the power source is not active, it is impossible to operate the signal transmitting circuit to transmit the air propagation signal.

In this case, the key is inserted into the key cylinder. The insertion of the key into the key cylinder is detected by the detecting means provided on the side of the key cylinder, as a result of which the primary coil is energized. And as the current flowing in the primary coil varies, an electromotive force is induced in the secondary coil. With the induced electromotive force as power source, the signal transmitting circuit operates to transmit the air propagation signal.

According to another aspect of the present invention, there is provided a key cylinder device comprising: a key cylinder body having a key inserting inlet; a shutter made of a magnetic material which is swung with a key inserted into the key inserting inlet, to open and close the key inserting inlet; a permanent magnet installed on the key cylinder body in such a manner that the permanent magnet is located near the shutter; and a magnetism detecting element mounted on the key cylinder body in such a manner that, when the shutter is closed, the magnetic force of the permanent magnet acts on the magnetism detecting element, the shutter, when swung open, interrupting the action of the magnetic force of the permanent magnet on the magnetism detecting element.

When the key is not inserted into the rotor, the shutter is closed, and therefore, the magnetic force of the permanent magnet acts on the magnetism detecting element. When, under this condition, the key is inserted thereinto, the shutter is swung open being pushed by the key, thus interrupting the action of the magnetic force of the permanent magnet on the magnetism detecting element; that is, the magnetic force of the permanent magnet is not applied to the magnetism detecting element.

That is, the presence or absence of the key can be detected by determining whether or not the magnetic force of the permanent magnet acts on the magnetism detecting element.

Thus, with the key cylinder device, the presence or absence of the key can be electrically detected, although it is simple in construction being essentially made up of the shutter, the permanent magnet, and the magnetism detecting element.

DETAILED DESCRIPTION OF THE PREFERRED EMBODIMENTS

One preferred embodiment of this invention, a signal transmitter for a wireless door locking device to which the technical concept of the invention is applied, will be described with reference to the accompanying drawings.

Figure 6:
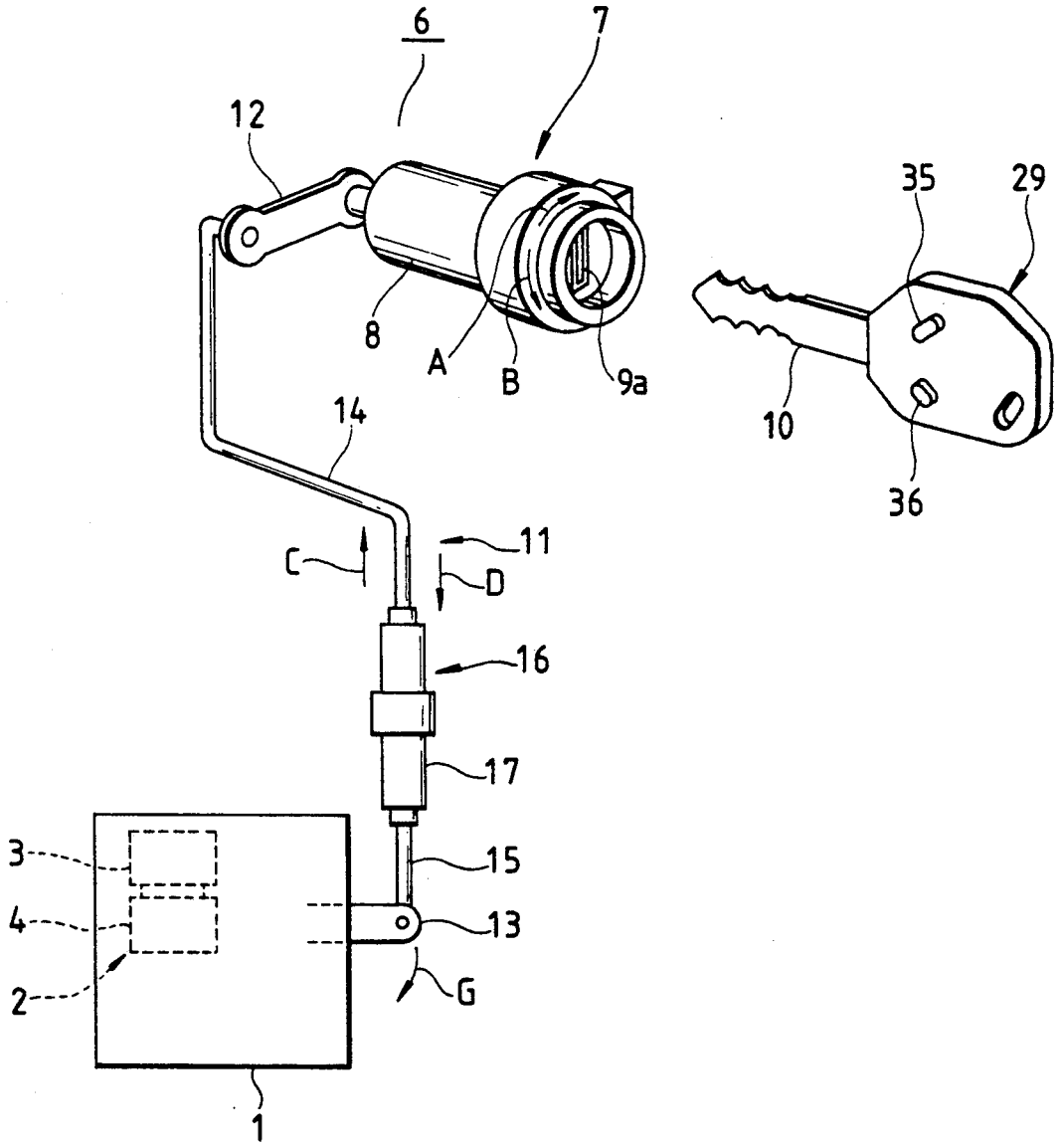
FIG. 6 is an explanatory diagram outlining the arrangement of a lock mechanism and its relevant components.

FIG. 6 shows a door lock mechanism 1 and its relevant parts. The lock mechanism 1 is mounted on a door (not shown), and designed as follows: When the lock mechanism 1 is given a locking displacement, it is engaged with a locking member provided on the side of the vehicle body, to lock the door; and when it is given a unlocking displacement opposite in direction to the locking displacement, it unlocks the door. The lock mechanism 1 can be operated both electrically or manually.

In order to electrically operate the lock mechanism 1, an electric operating mechanism 2 is provided which comprises electric actuators, namely, a locking electromagnet 3 and an unlocking electromagnet 4. When the locking electromagnet 3 is energized through a door locking and unlocking switch 5 shown in FIG. 7 which is mounted on the door beside the driver's seat, a movable iron core (not shown) is displaced by being attracted by the locking electromagnet 3, so that, the lock mechanism 1 is given the locking displacement, to lock the door. When the unlocking electromagnet 4 is energized through the door locking and unlocking switch 5, the movable iron core (not shown), being attracted by the unlocking electromagnet 4, is displaced in the direction opposite to the direction in which it is moved to lock the door, so that the lock mechanism 1 is given the unlocking displacement, to unlock the door.

A manual operating mechanism 6 for manually operating the lock mechanism 1 has a manual operating source which is a key cylinder 7 mounted on the door (not shown). The key cylinder 7 has a rotor casing 8, in which a rotor 9 is rotatably fitted. The rotor 9 has a key inserting inlet (keyhole) 9*a*, into which an ignition key 10 is inserted. The rotor 9 can be turned both in the locking direction of the arrow A and in the unlocking direction of the arrow B from the neutral position. The motions of turning the rotor 9 in the locking direction and in the unlocking direction are transmitted, as the locking displacement and the unlocking displacement, to the lock mechanism 1 through a link mechanism 11.

The link mechanism 11 comprises: a turning arm 12 secured to the rear end of the rotor 9 of the key cylinder 7; a turning arm 13 coupled to the lock mechanism 1; and an upper rod 14 and a lower rod 15 connected between the two arms 12 and 13. When the rotor 9 is turned in the locking direction of the arrow A to turn the turning arm 12 in the same direction, the upper rod 14 is moved in the direction of the arrow C (hereinafter referred to as "a pulling direction", when applicable). When the rotor 9 is turned in the unlocking direction of the arrow B to turn the turning arm 12 in the same direction, the upper rod 14 is moved in the direction of the arrow D (hereinafter referred to as "a pushing direction", when applicable) which is opposite to the direction of the arrow C.

An inhibiting mechanism 16 is provided between the upper rod 14 and the lower rod 15. The inhibiting mechanism 16 functions to transmit or not to transmit the movement, in the pushing direction, of the upper rod to the lower rod 15 when the rotor 9 is turned in the unlocking direction.

Figure 8:
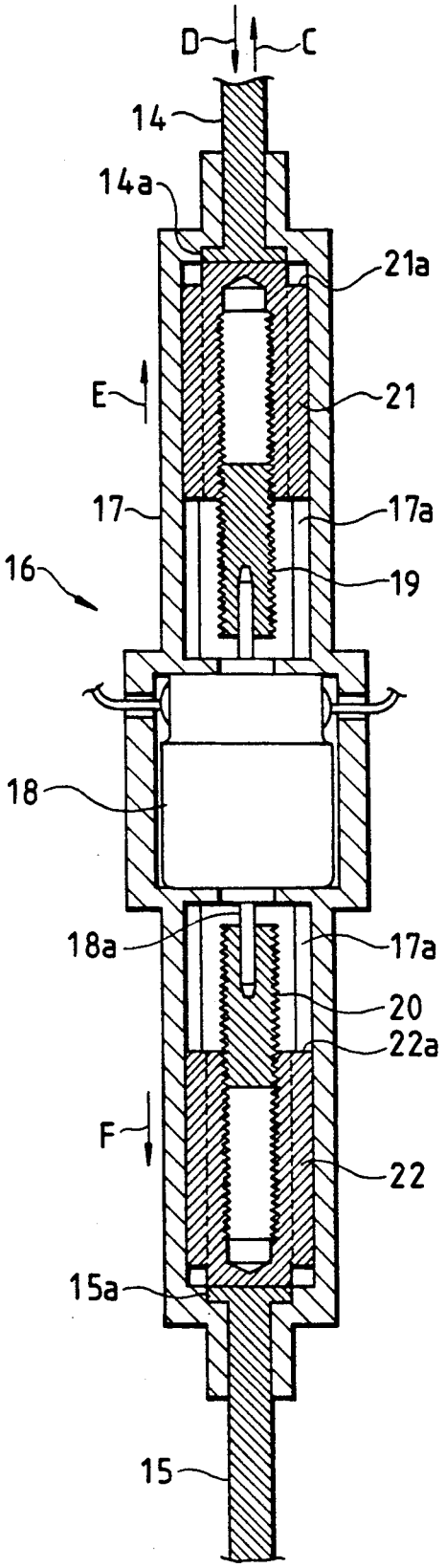
FIG. 8 is an enlarged longitudinal sectional view showing an inhibiting mechanism which is in linking state.

The structure of the inhibiting mechanism 16 is shown in FIG. 8 in more detail. In FIG. 8, reference numeral 17 designates a sleeve. The end portions of the upper rod 14 and the lower rod 15 are slidably fitted in both end portions of the sleeve 17. More specifically, the end portions of the upper rod 14 and the lower rod 15 are formed into large diameter portions 14*a* and 15*a*, respectively. Those large diameter portions 14*a* and 15*a* are locked to the sleeve 17 at both ends so as to prevent the rods 14 and 15 from coming out of the sleeve 17.

An electric actuator, namely, an electric motor 18 whose rotary shaft 18*a* is extended on both sides is provided in the sleeve 17 at the middle. The motor 18 is rotatable in both directions, in the forward direction and in the reverse direction. Threaded bars 19 and 20 are secured to both ends of the rotary shaft 18*a*, respectively. The male threads of the threaded bars 19 and 20 are opposite in winding direction to each other. The threaded bars 19 and 20 are engaged with nut members 21 and 22, respectively, which are slidably fitted in the sleeve 17 at both end portions. The nut members 21 and 22 have protrusions 21*a* and 22*a* which are extended radially outwardly. The protrusions 21*a* and 22*a* are engaged with grooves 17*a* which are formed in the inner wall of the sleeve 17 in such a manner that they are extended axially, thereby to prevent the nut members 21 and 22 from turning.

When the motor 18 is rotated in the forward direction, the nut members 21 and 22 are slid in the directions of the arrows E and F; that is, they are spaced away from each other. As a result, as shown in FIG. 8, the nut members 21 and 22 abut against the large diameter portions 14*a* and 15*a* of the upper and lower rods 14 and 15; that is, the large diameter portions 14*a* and 15*a* are pushed against the two end walls of the sleeve 17, so that the upper rod 14 is positively linked to the lower rod 15.

When, under this condition, the upper rod 14 is moved in the pushing direction of the arrow D, the movement is transmitted through the nut member 21, the threaded bar 19, the rotary shaft 18*a*, the threaded bar 20 and the nut member 22 to the lower rod 15, so that the latter 15 is moved in the same direction. This movement of the lower rod 15 in the pushing direction turns the turning arm 13 in the direction of the arrow G, so that the lock mechanism 1 is given the unlocking displacement.

Figure 9:
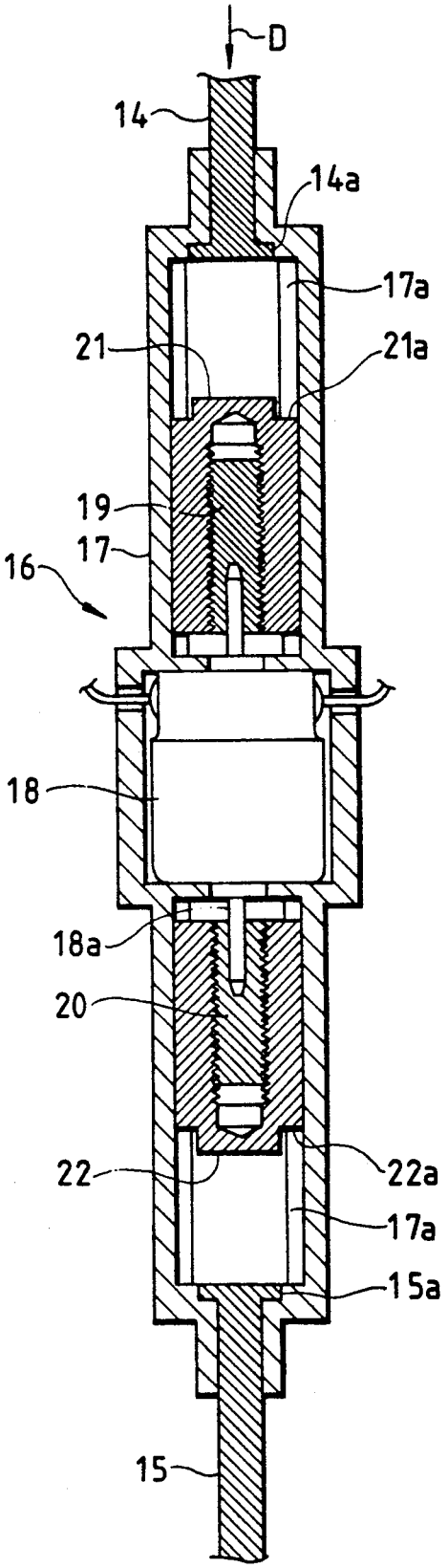
FIG. 9 is an enlarged longitudinal sectional view showing the inhibiting mechanism which is in unlinking state.

When, on the other hand, the motor 28 is rotated in the reverse direction, the nut members 21 and 22 are slid in the directions opposites to the directions of the arrows E and F, respectively; that is, they are moved toward each other. As a result, as shown in FIG. 9, a gap is formed between the nut member 21 and the large diameter portion 14*a* of the upper rod 14, and similarly a gap is formed between the nut member 22 and the large diameter portion 15*a* of the lower rod 15, so that the upper rod 14 and the lower rod 15 are not linked to each other. When, under this condition, the upper rod 14 is moved in the pushing direction of the arrow D, then it is merely slid, and the movement is not transmitted to the lower rod 15. Hence, even if the rotor 9 is turned in the unlocking direction, the link mechanism 11 gives no unlocking displacement to the lock mechanism 1.

As is apparent from the above description, only when the inhibiting mechanism 16 is in linking state, the link mechanism 11 gives the unlocking displacement to the lock mechanism 1 in response to the turn, in the unlocking direction, of the rotor, to unlock the door. In addition, the inhibiting mechanism is so designed that it is placed in unlinking state when the lock mechanism is in the locking state.

When the rotor 9 is turned in the locking direction of the arrow A, the upper rod 14 is moved in the pulling direction, and therefore no matter in what state the inhibiting mechanism 16 is; that is, whether it is in the linking state or in the unlinking state, the movement, in the pulling direction, of the upper rod 14 is transmitted to the lower rod 15 through the sleeve 17. That is, the lower rod 15 is moved in the pulling direction of the arrow C. As a result, the turning arm 13 is turned in the direction opposite to the direction of the arrow G, to give the locking displacement to the lock mechanism 1. Thus, when the rotor 9 is turned in the locking direction, the lock mechanism 1 is operated to lock the door whether the inhibiting mechanism 16 is in the linking state or in the unlinking state.

The rotor 9 of the key cylinder 7 has a shutter 23 behind the key inserting inlet 9*a* which is opened with the key 10 inserted into it. The shutter 23, which is made of a magnetic material such as iron plate, is swingable about its shaft 23*a* supported at both ends and the shutter 23 is held closed by being urged by a spring (not shown). Side boards 23*b* (only one shown) are provided on both side of the shutter in such a manner that they are integral with the latter.

A permanent magnet 24 is fixedly mounted inside the rotor 9 and near the shutter 23 in such a manner that the permanent magnet 24 is covered with the shutter 23 as indicated by the two-dot chain lines when the latter 23 is turned to open the key inserting inlet.

Figure 4:
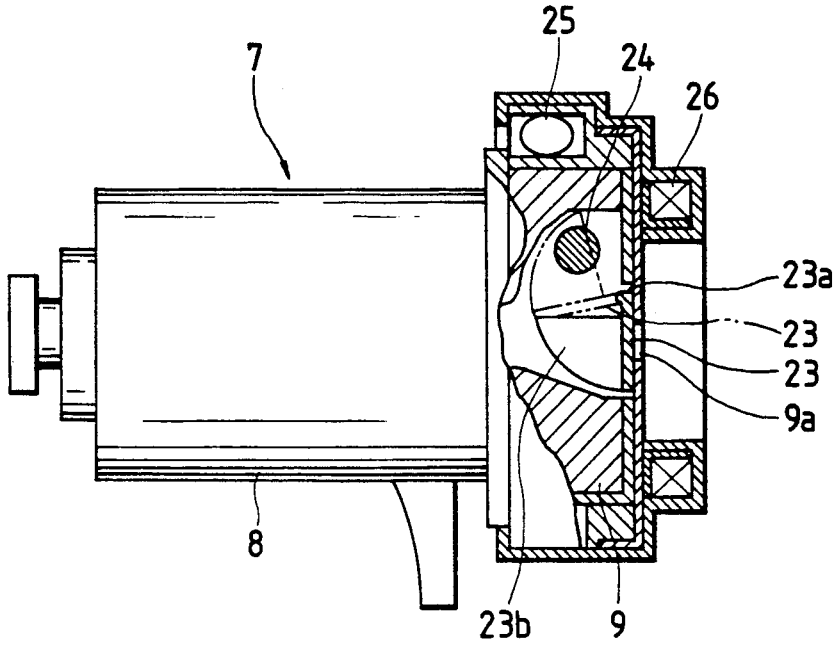
FIG. 4 is a side view, with parts cut away, showing the key cylinder.

A lead switch 25, as magnetic force detecting means, is provided outside the rotor 9 and near permanent magnet 24. The lead switch 25 is held open by the magnetic force of the permanent magnet 24 when the shutter 23 is closed. When the shutter 23 is opened by the insertion of the key 10 (as indicated by the two-dot chain lines in FIG. 4), the permanent magnet 24 is covered by the shutter 23 thus opened so that the lines of magnetic force of the permanent magnet 24 are caused to pass through the shutter 23, so that the action of the magnetic force of the permanent magent 24 on the lead switch 15 is decreased as much, whereby the lead switch closes. That is, the lead switch 25 is detecting means which is adapted to detect the insertion of the key 10 into the key cylinder 7.

Figure 5:
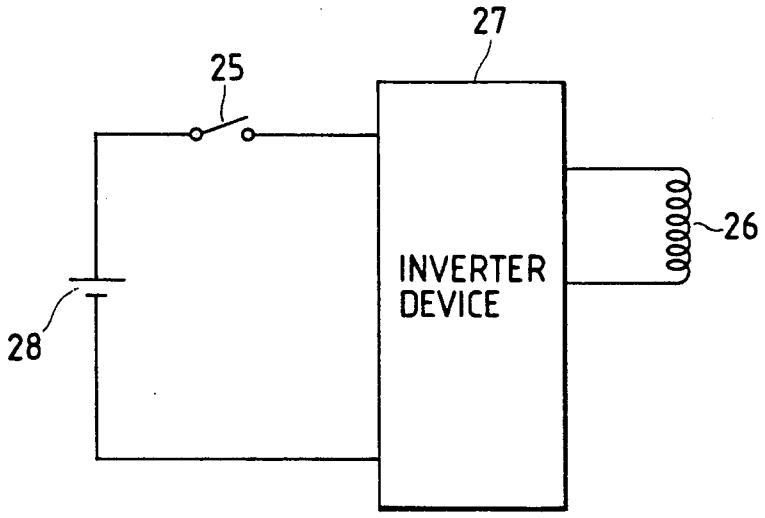
FIG. 5 is a circuit diagram, partly as a block diagram, showing an electrical circuit provided for the key cylinder.

A primary coil 26 is provided in the key cylinder 7 at the front end. As is seen from FIG. 5, the primary coil 26 is energized through an inverter device 27 when the lead switch 25 is turned on. In FIG. 5, reference numeral 28 is a battery on the vehicle body.

Figure 1:
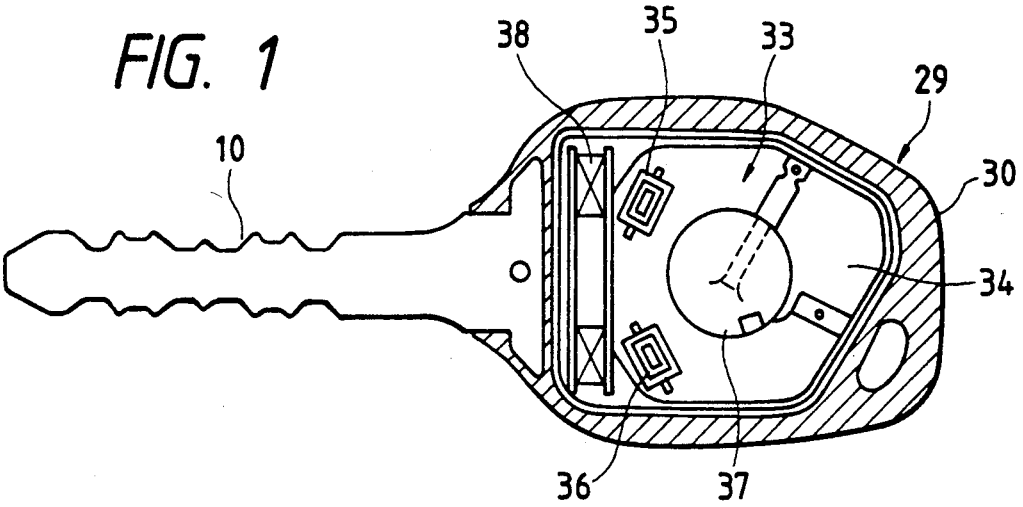
FIG. 1 is a horizontal sectional view showing a key in one embodiment of this invention.
Figure 2:
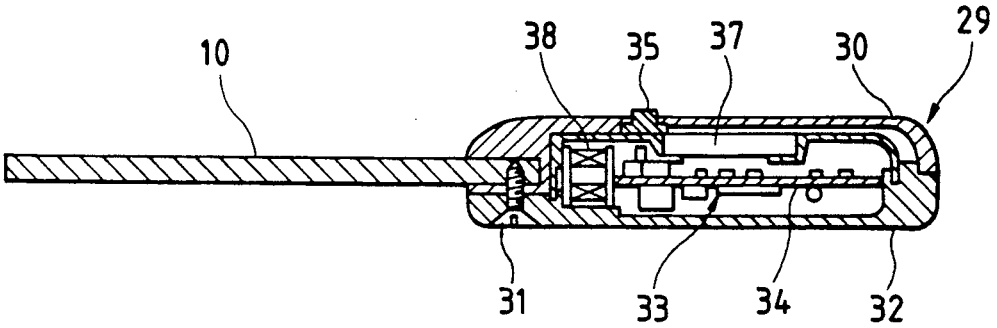
FIG. 2 is a vertical section view of the key.

As shown in FIGS. 1 and 2, the body 29 of the signal transmitter is mounted on the base portion of the key 10. The body 29 comprises: a first casing 30 which is formed on the key 10 by insert-molding; and a second casing 32 which is mounted on the first casing 30 with a screw 31 in such a manner that it covers the opening of the first casing 30.

Figure 3:
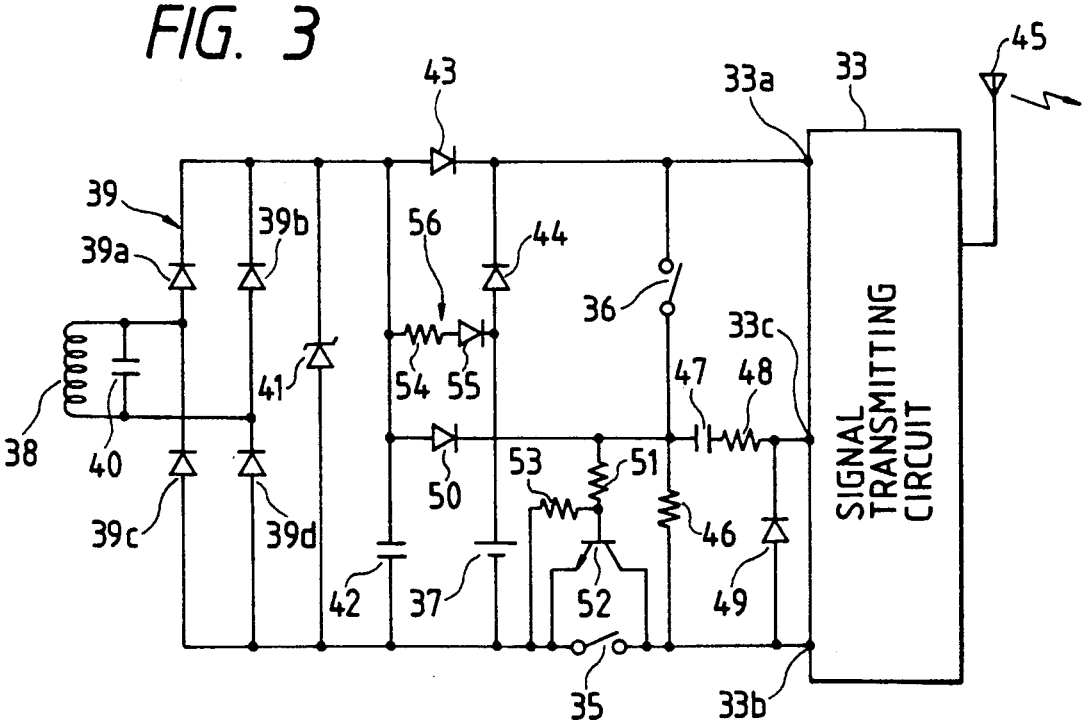
FIG. 3 is a circuit diagram, partly as a block diagram, showing an electrical circuit provided for the key.

The body 29 further comprises: a printed circuit board 34 on which a signal transmitting circuit 33 (as shown in FIG. 3) is formed; a push-button type locking switch 35 and a push-button type unlocking switch 36 for activating the signal transmitting circuit 33; a secondary battery 37 which is a power source for the signal transmitting circuit 33; and a secondary coil 38 which is to be coupled to the above-described primary coil 26 of the key cylinder 7.

The electrical arrangement of the body 29 on the key 10 will be described with reference to FIG. 3. A full-wave rectifying circuit 39 is formed by bridge-connecting diodes 39*a* through 39*d*. A parallel circuit of the above-described secondary coil 38 and a capacitor is connected between the AC input terminals of the full-wave rectifying circuit 39, and a parallel circuit of a constant voltage diode 41 and a capacitor 42 is connected between the DC output terminals thereof. The capacitor 42 is shunted by a series circuit of reverse-current blocking diodes 43 and 44 and the above-described secondary battery 37. The cathode of the diode 43 is connected to the positive voltage input terminal 33*a* of the signal transmitting circuit 33, and the negative terminal of the secondary battery 37 is connected through the aforementioned locking switch 35 to the negative voltage input terminal 33*b* of the signal transmitting circuit 33.

The signal transmitting circuit 33 has a signal input terminal 33*c* in addition to the aforementioned positive and negative voltage input terminals 33*a* and 33*b*. The signal transmitting circuit 33 is so designed that, when a signal applied to the signal input terminal 33*c* is at low level with a DC voltage applied between the positive and negative voltage input terminals 33*a* and 33*b*, the signal transmitting circuit 33 transmits an air propagation signal, which is a radio wave signal in the embodiment, through an antenna 45; that is, the circuit 33 transmits a locking signal through the antenna 45; and when the signal applied to the signal input terminal 33*c* is at high level, the circuit 33 transmits an unlocking signal through the antenna 45.

A series circuit of the above-described unlocking switch 36 and a resistor 46 is connected between the positive and negative voltage input terminals 33*a* and 33*b* of the signal transmitting circuit 33, and the resistor 46 is shunted by a series circuit of a capacitor 47, a resistor 48 and a diode 49. The connecting point of the resistor 48 and the diode 49 is connected to the signal input terminal 33*c*.

The connecting point of the unlocking switch 36 and the resistor 46 is connected through a reverse current blocking diode 50 to the anode of the diode 43. Both terminals of the locking switch 35 are connected to the emitter and collector of a transistor 51, respectively, the base of which is connected through a resistor 53 to the emitter.

A series circuit of a resistor 54 and a reverse current blocking diode 55 is connected between the anode of the diode 43 and the positive terminal of the secondary battery 37, thus forming a charging circuit 56.

When, in the normal case where the secondary battery 37 is active, the locking switch 35 is turned on, the DC voltage of the secondary battery 37 is applied between the positive and negative voltage input terminals 33*a* and 33*b* of the signal transmitting circuit 33, and the signal applied to the signal input terminal 33*c* is set to low level, so that the signal transmitting circuit 33 transmits the locking signal through the antenna 45; whereas when the unlocking switch 36 is turned on, the transistor 52 is rendered conductive (on), so that the DC voltage of the secondary battery 37 is applied between the voltage input terminals 33*a* and 33*b* of the signal transmitting circuit 33, while the signal applied to the signal input terminal 33*c* is raised to high level, as a result of which the signal transmitting circuit 33 transmits the unlocking signal through the antenna 45.

Figure 7:
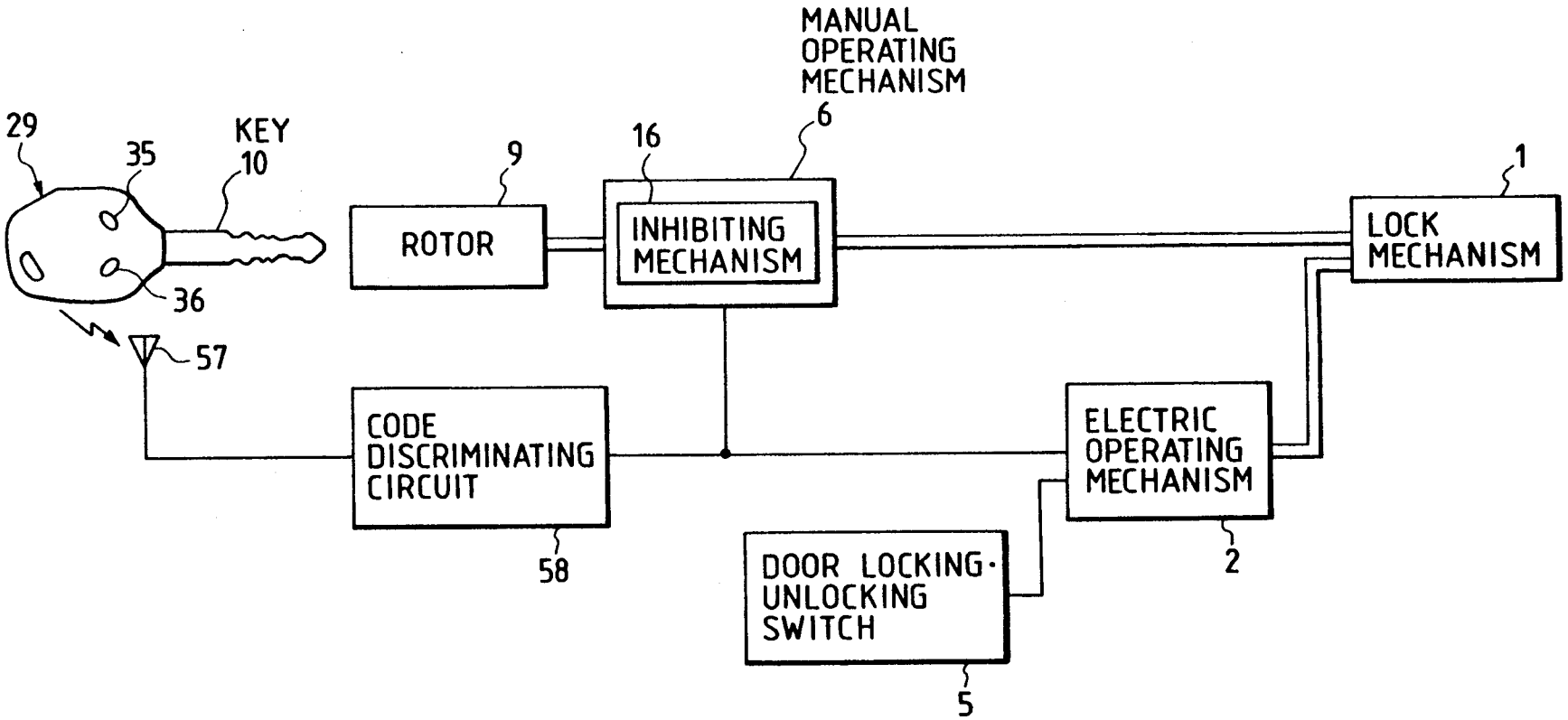
FIG. 7 is a block diagram showing mechanical and electrical means concerning the lock mechanism.

The radio wave signal thus transmitted is received by an antenna 57 installed on the motor vehicle as shown in FIG. 7. The radio wave signal is a signal representing a code of several tens of bits. The code of the locking signal is different in content from the code of the unlocking signal. The locking signal and the unlocking signal have codes predetermined for the motor vehicle only; that is, different codes are provided for different motor vehicles.

The radio wave signal received by the antenna 57 is applied to received signal discriminating means, namely, a code discriminating circuit 58, where it is determined whether or not the code of the radio wave signal belongs to the motor vehicle, and it is also determined whether the code is of the locking signal or whether it is of the unlocking signal. When it is determined that the code belongs to the motor vehicle, and is of the locking signal, the locking electromagnet 3 of the electric operating mechanism 2 is energized to cause the lock mechanism 1 to operate to lock the door; whereas when it is determined that the code belongs to the motor vehicle, and is of the unlocking signal, the unlocking electromagnet 4 is energized to cause the lock mechanism 1 to operate to unlock the door, while the motor 18 of the inhibiting mechanism 16 is turned in the forward direction to place the inhibiting mechanism 16 in the linking state.

The operation of the door locking and unlocking system thus organized will be described. When the driver, leaving his motor vehicle, operates the locking switch 35 on the key 10 to lock the door, the signal transmitting circuit 33 is activated, so that the locking signal is transmitted, as a radio wave signal, through the antenna 45. The radio wave signal thus transmitted is received by the antenna 57 on the motor vehicle, and applied to the code discriminating circuit 58.

Only when the code of the radio wave signal is the one predetermined for locking the door, the code discriminating circuit 58 operates to energize the locking electromagnet 3 of the electric operating mechanism 2, so that the lock mechanism 1 is given the locking displacement, to lock the door. In response to the locking operation of the lock mechanism 2, the motor 18 of the inhibiting mechanism 16 is turned in the reverse direction thereby to place the inhibiting mechanism in the unlinking state (cf. FIG. 9).

In order to unlock the door and enter the motor vehicle, the unlocking switch 36 on the key 10 is operated. As a result, the signal transmitting circuit 33 is activated, so that the unlocking signal is transmitted, as a radio wave signal, through the antenna 45. The radio wave signal is received by the antenna 57 on the motor vehicle, and applied to the code discriminating circuit 58.

The code discriminating circuit 58 determines whether or not the code of the radio wave signal is the one predetermined for unlocking the door. When it is determined that the radio signal wave is the one predetermined for unlocking the door, the code discriminating circuit 58 operates to energize the unlocking electromagnet 4 of the electric operating mechanism 2, and to turn the motor 18 of the inhibiting mechanism 16 in the forward direction thereby to place the latter 16 in the linking state (cf. FIG. 8). Upon energization of the unlocking electromagnet, the lock mechanism is given the unlocking displacement, to unlock the door.

When the code of the radio signal wave is not the one predetermined for unlocking the door, the code discriminating circuit 58 does not operate to energize the unlocking electromagnet 4, nor to turn the motor 18 in the forward direction. Hence, in this case, the locking mechanism 1 is left as it is, and the door is not unlocked.

Let us consider the case where, the door has been locked, and, in order to unlock the door, a person other than the driver turns the rotor 9 of the key cylinder 7 in the unlocking direction with something inserted into it. In this case, the turning arm 12 is turned in the unlocking direction of the arrow B, so that the upper rod 14 is moved in the pushing direction of the arrow D. However, the door cannot be unlocked. This will be described in more detail. In this case, the inhibiting mechanism 16 is in the unlinking state as shown in FIG. 9; that is, the gap is provided between the upper rod 14 and the nut member 21. Hence, the upper rod 14 is merely slid inside the sleeve, and the movement of the upper rod is not transmitted to the lower rod 15. Thus, although the rotor 9 is turned in the unlocking direction, the lock mechanism is held as it is; that is, the door is not unlocked.

Thus, in the case where the code of the radio wave signal transmitted by the signal transmitting circuit 33 on the key is different from the one predetermined for unlocking the door, the inhibiting mechanism is not placed in the linking state, and although the manual operating mechanism 6 is provided, it is impossible to unlock the door with the manual operating mechanism 6. This is greatly effective in preventing theft.

Using the key repeatedly for a long time may result in the difficulty that the unlocking electromagnet 4 of the electric operating mechanism 2 is broken or becomes out of order, so that it is no longer possible to use the unlocking electromagnet 4 to operate the lock mechanism 1. In this case, the manual operating mechanism 6 is used to unlock the door. First, the unlocking switch 36 of the key 10 is operated to cause the signal transmitting circuit 33 to transmit the unlocking signal. Similarly as in the above-described case, the motor 18 in the inhibiting mechanism 16 is turned in the forward direction, so that the latter 16 is placed in the linking state.

Under this condition, the rotor 9 is turned in the unlocking direction with the key 10 inserted into it, so that the turning arm 12 is turned in the same direction to move the upper rod 14 in the pushing direction. The movement of the upper rod 14 in the pushing direction is transmitted to the lower rod 15 through the inhibiting mechanism 16 which is in the linking state. The movement of the lower rod 15 in the pushing direction turns the turning arm 13 in the direction of the arrow G to give the unlocking displacement to the lock mechanism, thus causing the lock mechanism 1 to operate to unlock the door.

As was described above, even if the electric operating mechanism 2 becomes out of order, the lock mechanism can be activated by means of the manual operating mechanism 6, to unlock the door.

On the other hand, when the key is used repeatedly for a long time, the power source of the signal transmitting circuit 33, namely, the secondary battery 37 may be consumed up. In this case, the signal transmitting circuit 33 does not work any longer; that is, it transmits no radio wave signal, and therefore it is impossible to unlock door by using the electric operating mechanism 2. And it is also impossible to place the inhibiting mechanism 16 in the linking state, and therefore it is impossible to unlock the door by using the manual operating mechanism 6.

In this case, the following method is practiced to open the door: The key 10 is inserted into the key cylinder through the key inserting inlet 9*a*. In this operation, the shutter 23 is swung open by being pushed by the key 10 (as indicated by the two-dot chain lines in FIG. 4), thus covering the permanent magnet 24. As a result, the larger of the lines of magnetic forces of the permanent magnet 24 are caused to pass through the shutter 23; that is, the number of magnetic force lines passing through the lead switch 25 is decreased, so that the latter 25 closes. Since the lead switch 25 is turned on, the primary coil 26 is energized through the inverter device 27.

When the current flowing in the primary coil is varied being controlled by the inverter device 27, an electromotive force is induced in the secondary coil 38 provided on the key 10. Owing to the induced electromotive force, the transistor 52 is rendered conductive (on), so that the DC voltage is applied between the positive and negative voltage input terminals 33*a* and 33*b* of the signal transmitting circuit 33, while the signal applied to the signal input terminal 33*c* is raised to high level. As a result, the signal transmitting circuit 33 transmits the unlocking signal through the antenna 45 for a predetermined period of time. On the other hand, when the electromotive force is induced in the secondary coil 38 as was described above, the capacitor 42 is charged, and accordingly the secondary battery 37 is charged.

When the signal transmitting circuit 33 transmits the unlocking signal in the above-described manner, the unlocking signal is received by the antenna 57 on the motor vehicle and applied to the code discriminating circuit 58, where it is determined whether or not the code of the radio wave signal is the one predetermined from unlocking the door. When it is determined that the radio wave signal has the predetermined code, the code discriminating circuit 58 operates to energize the unlocking electromagnet 4 of the electric operating mechanism 2, and to turn the motor 18 of the inhibiting mechanism 16 in the forward direction so as to place the latter 16 in the linking state. Upon energization of the unlocking electromagnet 4, the lock mechanism 1 is given the unlocking displacement, to unlock the door.

If summarized, even in the case where the power source of the signal transmitting circuit 33 provided on the key 10, namely, the secondary battery 37 has become inactive and is consumed up, and therefore it becomes impossible to operate the signal transmitting circuit 33, the door can be unlocked by inserting the key 10 into the key cylinder 7. That is, upon insertion of the key 10, the primary coil 26 provided on the side of the key cylinder 7 is energized to induce an electromotive force in the secondary coil 38 provided on the side of the key 10, as a result of which the signal transmitting circuit is activated to transmit the unlocking signal, to unlock the door.

On the other hand, the device of the present invention is designed to employ the following purpose in normal condition of the device.

When the key 10 is not inserted into the key cylinder body 7, the shutter 23 is held closed, and therefore the magnetic force of the permanent magnet 24 acts on the lead switch 25 so that the latter 25 is held off.

Under this condition, the key 10 is inserted into the rotor 9 through the key inserting inlet 9*a*. More specifically, as the key 10 is inserted, the shutter 23 is swung open being pushed by the key 10, so as to permit the further insertion of the key 10. When the shutter has been swung open, it covers the permanent magnet 24, so that almost all the lines of magnetic force of the permanent magnet 24 are caused to pass through the shutter 23; that is, the action of the magnetic force of the permanent magnet 24 on the lead switch 25 is decreased as much, whereby the lead switch 25 closes.

Thus, the insertion of the key 10 can be electrically detected from the fact that the lead switch 25 is closed in the above-described manner.

When the lead switch 25 is closed, the primary coil 26 is energized through the inverter device 27. Upon energization of the primary coil 26, an electromotive force is induced in the secondary coil 38 on the key 10.

The electromotive force thus induced is utilized to forcibly activate the signal transmitting circuit 33 provided on the key 10 to transmit the unlocking signal for a predetermined period of time or to charge the secondary battery 37.

When the key 10 is removed from the key inserting inlet 9*a*, the shutter 23 is turned in the closing direction by the elastic force of the spring (not shown) to close the key inserting inlet 9*a*. As the shutter 23 is turned in this way, the lead switch 25 opens again.

When, in the above-described embodiment, the key is inserted into or removed from the key cylinder, it is determined whether or not the magnetic force of the permanent magnet 24 acts on the lead switch 25, thereby to electrically detect the presence or absence of the key 10.

The detection of the presence or absence of the key 10 is achieved with simple means which is made up of the shutter 23, the permanent magnet 24 and the lead switch 25, and requires no large space. Furthermore, the presence or absence of the key is detected according to whether or not the magnetic force of the permanent magnet 24 acts on the lead switch 25. Hence, the detection is scarcely affected by external environmental conditions, and is therefore high in reliability.

In the above-described embodiment, the presence or absence of the key 10 is detected to energize or deenergize the primary coil 26; however, it should be noted that the invention is not limited thereto or thereby. That is, the detection of the presence or absence of the key may result in detection of the fact that the driver has forgotten to remove the key 4 from the key cylinder.

In the above-described embodiment, the inhibiting mechanism 16 is provided for the manual operating mechanism; however, the technical concept of the invention may be applied to the manual operating mechanism having no inhibiting mechanism.

Furthermore in the above-described embodiment, the air propagation signal is a radio wave signal; however, the invention is not limited thereto or thereby. That is, it may be an ultrasonic signal or an infrared signal.

In addition, while the invention has been described with reference to the motor car's wireless door locking device; however, it should be noted that the technical concept of the invention can be applied to wireless door locking devices of other types.

As is apparent from the above description, in the signal transmitter comprising: the key which is to be inserted into the key cylinder; the signal transmitting circuit for transmitting the air propagation signal; and its power source for the signal transmitting circuit, the signal transmitting circuit and the power source being provided on the key, the key cylinder has the detecting means for detecting the insertion of the key into the key cylinder, and the primary coil which is energized when the detecting means detects the insertion of the key into the key cylinder, and the key has the secondary coil in which an electromotive force is induced as the current in the primary coil varies with the key inserted into the key cylinder, the electromotive force thus induced in the secondary coil being utilized to activate the signal transmitting circuit. Hence, even when the power source becomes inactive and is consumed, the signal transmitting circuit can be operated with the key inserted into the key cylinder. This effect should be highly appreciated in practical use.

Further, as is apparent from the above description, with the key cylinder device of the invention, the shutter turned in association with the operation of the key, the permanent magnet, and the magnetism detecting element cooperate to detect the presence and absence of the key. That is, the key cylinder device is simple in construction, and yet able to electrically detect the presence or absence of the key with high accuracy.

What is claimed is:

1. A key cylinder device comprising:

a rotor having a key inserting inlet;

a casing in which said rotor is rotatably fitted;

a shutter mounted by said rotor for swinging movement between open and closed positions, said shutter blocking said key inserting inlet in said closed position and being swung to said open position in response to a key being inserted into said key inserting inlet, said shutter being made of magnetic material;

a permanent magnet installed on said rotor in such a manner that said permanent magnet is located near said shutter; and magnetism detecting means for receiving a magnetic force of said permanent magnet, said magnetism detecting means being mounted by said casing, wherein said shutter interrupts said magnetic force of said permanent magnet on said magnetism detecting means, while in said open position.

2. A key cylinder device as claimed in claim 1, wherein said magnetism detecting means is mounted to receive said magnetic force of said permanent magnet when said shutter is in said closed position.

3. A key cylinder device as claimed in claim 1, wherein said key includes a signal transmitting circuit for transmitting an air propagation signal and a power source for said signal transmitting circuit.

4. A key cylinder device as claimed in claim 3, wherein said key cylinder further includes a primary coil, said detecting means enabling energization of said primary coil while said shutter is in said open position.

5. A key cylinder device comprising:

a key including a signal transmitting circuit for transmitting an air propagation signal and a power source for said signal transmitting circuit;

a rotor having a key inserting inlet;

a casing in which said rotor is rotatably fitted;

a shutter mounted by said rotor for swinging movement between open and closed positions, said shutter blocking said key inserting inlet in said closed position and being swung to said open position in response to the key being inserted into said key inserting inlet, said shutter being made of magnetic material;

a permanent magnet installed on said rotor in such a manner that said permanent magnet is located near said shutter; and magnetism detecting means for receiving a magnetic force of said permanent magnet, said magnetism detecting means being mounted by said casing, said shutter interrupting said magnetic force of said permanent magnet on said magnetism detecting means while in said open position; and a primary coil mounted on said casing, said detecting means enabling energization of said primary coil while said shutter is in said open position;

said key further including a secondary coil transformer coupled with said primary coil while said key is inserted in said key inserting inlet, said secondary coil generating an electromotive force in response to a variation of a current flowing in said primary coil to power said signal transmitting circuit.

* * * * *